United States Patent [19]

Wetherton

[11] 4,214,680

[45] Jul. 29, 1980

[54] DRAWDOWN HOPPER ISOLATION SYSTEM HAVING ISOLATORS WITH FABRIC LAYS

[75] Inventor: William M. Wetherton, Louisville, Ky.

[73] Assignee: Carman Industries, Inc., Jeffersonville, Ind.

[21] Appl. No.: 945,470

[22] Filed: Sep. 25, 1978

[51] Int. Cl.[2] ..... B65G 3/12

[52] U.S. Cl. ..... 222/161; 198/760; 222/181; 222/198; 248/638

[58] Field of Search ..... 222/161, 181, 185, 198, 222/460, 462; 248/562, 608, 609, 613, 614, 615, 632–636, 659, 638; 414/288; 198/760; 193/2 B; 267/152; 293/136; 428/113, 114, 137, 250, 284, 492

[56] References Cited

U.S. PATENT DOCUMENTS

| | | | |
|---|---|---|---|
| 2,787,315 | 4/1957 | Siebert | 248/632 X |
| 3,178,068 | 4/1965 | Dumbaugh | 222/161 |
| 3,257,040 | 6/1966 | Dumbaugh et al. | 222/161 |
| 3,399,103 | 8/1968 | Salyer et al. | 248/633 X |
| 3,866,073 | 2/1975 | Gjaja | 248/634 X |
| 4,025,676 | 5/1977 | Koellisch | 248/633 X |
| 4,093,764 | 6/1978 | Duckett et al. | 428/113 |

*Primary Examiner*—Robert J. Spar
*Assistant Examiner*—Fred A. Silverberg
*Attorney, Agent, or Firm*—Wood, Herron & Evans

[57] ABSTRACT

A drawdown hopper isolation system having a series of isolators supporting the hopper in spaced relation from a support surface. Each of the isolators is comprised, in preferred form, of a rubber block having an axial bore therethrough, a series of parallel nylon fabric lays being axially spaced one from another within the block. The nylon fabric lays are rotationally oriented in random fashion, relative to the axis of the block, so as to insure relatively even lateral deflection of the isolator in response to vibration of the hopper. A stud fixed to the hopper extends into one end of the isolator's bore, and a stud fixed to the hopper support surface extends into the other end of the isolator's bore, thereby locating the hopper in a desired position on the support surface.

10 Claims, 4 Drawing Figures

DRAWDOWN HOPPER ISOLATION SYSTEM HAVING ISOLATORS WITH FABRIC LAYS

This invention relates to isolators. More particularly, this invention relates to an isolator and an isolation system adapted for use with a drawdown hopper.

Drawdown hoppers are well known to the prior art. The drawdown hopper is particularly adapted for use in reclaiming particulate material from a store pile of that particulate material, especially in an outdoors environment where rainfall and/or freezing temperatures may cause the material to bind or stick together. The drawdown hopper is located beneath the storage pile, and during operation the hopper transmits vibration shock waves up into the pile due to vibration of the hopper itself. It is these shock waves, which are generally uniformly and concentrically produced relative to the hopper's position beneath the storage pile, which produce an optimum drawdown effect in the pile. This vibration draws down the particulate material into the hopper and, thereafter, discharges the material out of the hopper onto a conveyor device. Such a vibratory drawdown hopper structure eliminates certain typical problems encountered with reclaiming materials from a particulate storage pile such as, for example, rat-holing, bridging, plugging and the like.

One typical drawdown hopper structure which has seen significant commercial success in the trade is illustrated in Dumbaugh U.S. Pat. No. 3,178,068, assigned to the assignee of this application. In this prior art drawdown hopper, the hopper itself is vibrated in a generally axial direction, and is oscillated in a generally rotational direction, relative to the axis of the hopper, all for the purpose of producing a generally three dimensional vibratory motion in the hopper which, in turn, induces shock waves into the storage pile above the hopper. However, the isolation system by which this drawdown hopper is mounted on a fixed support surface is subjected to significant and substantial compression and shear forces during operation of the drawdown hopper.

Accordingly, it has been one objective of this invention to provide an improved drawdown hopper isolation system that provides an efficient means for isolating the drawdown hopper from its support surface during vibratory operation of the hopper, that system establishing an optimum useful life over which the isolation characteristics do not substantially vary.

It has been another objective of this invention to provide an improved isolator device, particularly adapted for use with a vibratory drawdown hopper, which provides a desirable minimum compression deflection when the hopper is at rest, which provides a desirable maximum compression deflection when the hopper is at use under maximum use conditions, and which provides a desirable compression load/deflection curve over the wide load range to which the isolator may be subjected, all while permitting limited lateral deflection of the isolator over that entire useful compression load range, without unduly limiting the useful life of the isolator device.

In accord with these objectives, this invention contemplates a drawdown hopper isolation system having a series of novel isolators supporting the hopper in spaced relation from a support surface. Each of the novel isolators is comprised, in preferred form, of a rubber block having an axial bore therethrough, a series of parallel nylon fabric lays being axially spaced one from another within the block. The nylon fabric lays are rotationally oriented in random fashion relative to the axis of the block, so as to insure relatively even lateral deflection of the isolator in response to vibration of the hopper. A stud fixed to the hopper extends into one end of the isolator's bore, and a stud fixed to the support surface extends into the other end of the isolator's bore, thereby locating the hopper in a desired position on the support surface.

Other objectives and advantages of the invention will be more apparent from the following detailed description taken in conjunction with the drawings in which.

Figure 1:
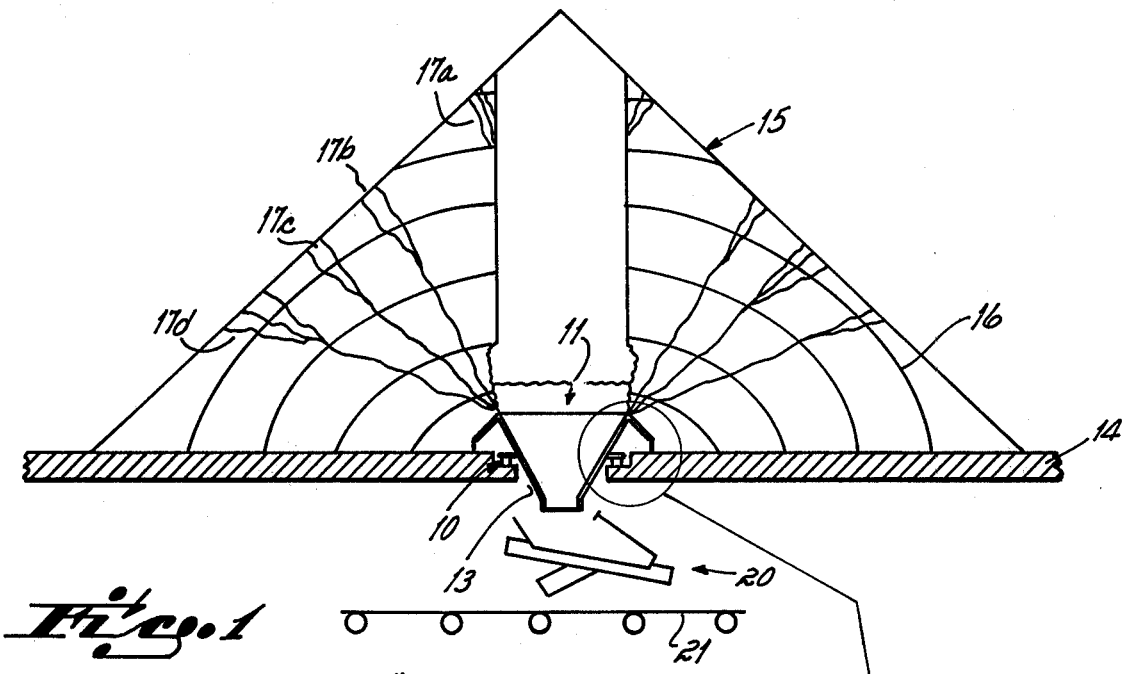
FIG. 1 is a diagrammatic side view illustrating a drawdown hopper in operational relation with a granular material storage pile, and supported in accord with the isolation system of this invention.
Figure 2:
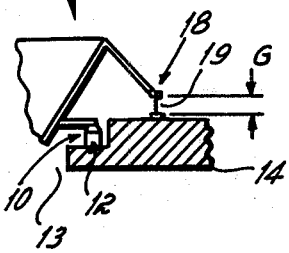
FIG. 2 is an enlarged view of the encircled portion of FIG. 1.

The operating environment of the improved isolation system 10 for a drawdown hopper 11 in accord with the principles of this invention is particularly shown in FIG. 1. As shown in that figure, the drawdown hopper 11 is mounted by a series of rubber block isolators 12 in an opening 13 of a fixed support surface or floor 14. A pile 15 of granular material, e.g., coal, is piled directly above the drawdown hopper 11, shock waves 16 being induced in that pile due to vibration of the hopper. The vibratory motion of the hopper 11 is created by eccentric weight type drive means, not shown, mounted on the hopper. The shock waves 16 cause the granular material 15 to be drawn down into the hopper 11 in a generally ever-expanding inverted conical fashion as illustrated by lines 17*a*–17*d*. The granular material 15 is prevented from passing through the opening 13 between the hopper 11 and the opening by a seal ring assembly 18 mounted to the external periphery of the hopper, and also connected to the floor 14. This seal ring assembly 18 includes a flexible skirt 19 that allows for the vibratory motion of the hopper 11 relative to the floor 14 while maintaining a seal therebetween. The granular material 15 drawn down into the hopper 11 is discharged into a feeder 20, and is subsequently metered by that feeder onto a conveyor belt 21 for conveyance to a use location. A more particular description of the drawdown hopper 11 is found in Dumbaugh U.S. Pat. No. 3,178,068, issued Apr. 13, 1965, the description of which is incorporated herein by reference.

Figure 3:
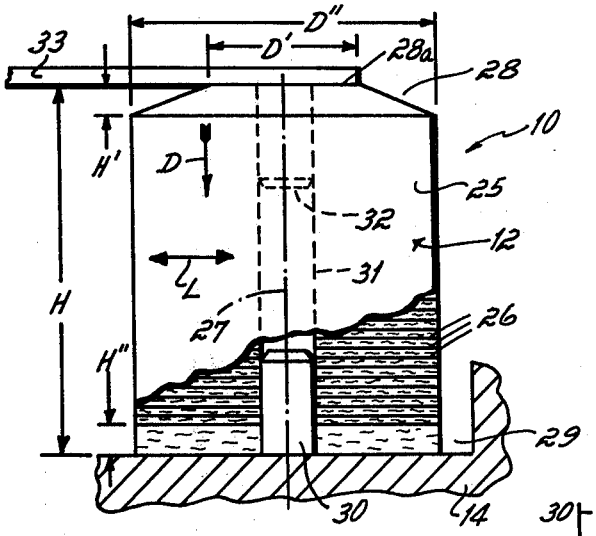
FIG. 3 is a partially broken away side view illustrating in detail an isolator in accord with the principles of this invention.

The isolation system 10 used to support the drawdown hopper 11 on support surface 14 includes a number of isolators 12 spaced symmetrically one from another around the periphery of the hopper; one isolator 12 is illustrated in detail in FIG. 3. The number of isolators 12 used is dependent on the height of pile 15, and on the physical characteristics of the material being handled. As shown in FIG. 3, each isolator 12 is comprised of a rubber block 25 having a series of nylon fabric lays 26 spaced axially one from another, and parallel one to the other, throughout the height H of the block, the lays all being oriented generally transverse to the center axis 27 of the block. All fabric lays 26 are rotated relative one to another, during manufacture of the isolator 12, so that the warp and weft directions of each lay is oriented in relatively random fashion relative to the warp and weft direction of all other fabric lays from the top end 28 to the bottom end 29 of the isolator. In other words, and relative to the center line axis 27 of the isolator 12, the nylon fabric lays 26 are all positioned at a different rotational position one from another so that the effect is a random rotational orientation of the fabric lays when the assembly is viewed coaxially of the isolator. This random orientation, it has been found, optimizes the lateral L deflection characteristics of the isolator in all radial directions relative to the center line axis 27 of the isolator. In other words, the random rotational orientation of the fabric lays 26 from the top 28 to the bottom 29 of the isolator block 25 tend to insure that the lateral L deflection characteristics of the isolator 12 will remain substantially constant no matter at what peripheral location the deflection forces are received on the isolator block.

The nylon fabric lay isolator 12 is not directly connected to either the drawndown hopper 10 itself, or to the support surface 14. However, and as shown in FIG. 3, the novel isolator 12 is retained in fixed lateral location relative to the floor 14 by a stud 30 fixed to that support surface which extends up in axial bore 31 defined in the isolator. Further, the drawdown hopper 10 is retained in fixed lateral relation with the isolator 12 by stud 32 fixed to mounting bracket 33 on the drawdown hopper 10 which extends down into the axial bore 31. Hence, the drawdown hopper 11 is prevented from 'walking' relative to the support surface 14, in response to the vibratory motion induced therein, by this stud 30, 32 interconnection with the isolator. However, the stud 30, 32 interconnect structure does prevent the drawdown hopper 10 from inducing axial tension forces in the isolator 12, since no rigid vertical or axial connection is present between the hopper and the isolator, or between the isolator and the floor 14. This stud 30, 32 interconnect structure, therefore, tends to optimize the useful life of the isolator 12.

Figure 4:
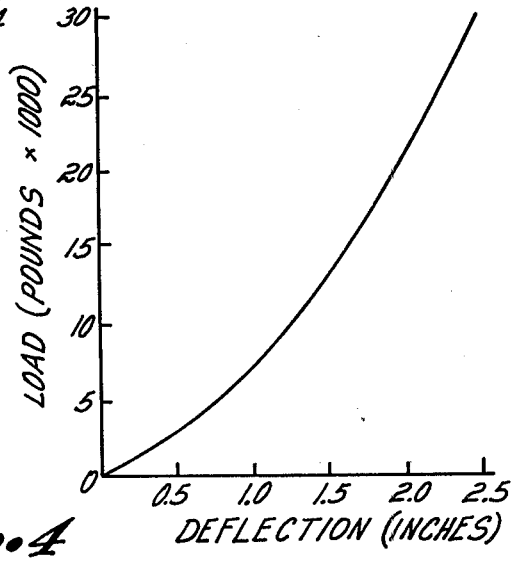
FIG. 4 is a load-deflection curve illustrating the load-deflection characteristics of an isolator in accord with the principles of this invention.

The top or head section 28 of the isolator block 25, as particularly shown in FIG. 3, is preferably formed in the nature of a frusto-cone that defines an upper surface 28*a* on which the hopper's mount bracket 33 rests. This frusto-conical head portion 28 of the isolator 12 does not include any nylon fabric lays at all. It has been found desirable to provide a constant minimum deflection of the isolator 12 at a no-load condition on the vibratory hopper 10, i.e., at a condition where only the hopper is supported by the isolator blocks 25 and no granular pile 15 of any kind is disposed above the hopper, so as to insure a natural vibration frequency less than the operating vibration frequency of the hopper itself. The lack of nylon fabric lays in the head section 28 insures that a minimum deflection D, e.g., about $\frac{3}{8}''$, will occur in response to a compressive load, e.g., about 2000 lbs., induced on each isolator block when the hopper is in the no load and rest condition. With regard to the nylon fabric lays 26 spaced longitudinally of the isolator's axis 27, and when all nylon fabric lays are of the same fabric characteristics, the farther the nylon lays are spaced apart the softer is the isolator in response to compressive forces in deflection direction D, and the closer together the nylon lays are spaced the stiffer is the isolator in response to compressive forces in deflection direction D. Further, and if the nylon lays 26 are too far apart, bulging between layers results. Additionally, and to establish an isolator of a given compression load-deflection characteristic curve, nylon fabric lays 26 that use a lighter fabric (e.g., lighter by fabric weight, or by thread count) require that the nylon fabric lays be spaced closer together to maintain the desired load-deflection curve. And if the nylon fabric lays 26 are spaced further apart, a heavier fabric (e.g., heavier by fabric weight, or by thread count) must be used to maintain the desired load-deflection curve of the isolator 12. In this regard, and in the drawdown hopper environment, it is quite desirable that the compression load-deflection curve of each isolator be as illustrated in FIG. 4. A minimum deflection (which is desirable, and as shown in FIG. 4) occurs at a relatively low compression load so as to allow the isolator system 12 to have a natural vibration frequency less than the operating vibration frequency of the hopper 10, a loading of about 2,000 pounds (the free weight of any empty hopper 10) resulting in an axial deflection of about 0.4". But at high compression loadings on the isolator 12, it is desirable that not too great a deflection D occur. The reason why a high deflection D at high loadings is not desired is that the gap G between the hopper's mounting bracket 33 and the floor 14 must be great enough to accommodate that deflection, but not too great as to cause a seal problem between the floor and the hopper itself. As shown in the FIG. 4 graph, a maximum deflection of about 2.5" at a 30,000 pound compression load is preferred. Further as shown in the graph, a deflection D of about 1.25" at a 10,000 pound compression load, and a deflection D of about 2.0" at a 20,000 pound compression load is desirable for isolators 12 used in the drawdown hopper 10 isolation system. Hence, the frusto-conical head portion 28 of the isolator 12 tends to make the isolator soft at low compression loads, while the randomly oriented nylon fabric lays 26 in the body portion of the isolator makes the isolator stiff at high compression loads. The isolator 12 is therefore responsive to support of minimum and maximum compressive loads D in different ways in light of its structure, and is also responsive to support of lateral deflection loads L to provide a generally constant lateral stiffness throughout its height.

A specific isolator 12 structure which provides the desirable FIG. 4 load-deflection curve illustrated, and which is operable with a drawdown hopper 10 of the type described above to provide the novel isolation system for that hopper, is of that structural configuration illustrated in FIG. 3. Dimensionally, the isolator 12 is of an 8" diameter D", 9" height H, and includes a head portion of $\frac{3}{4}''$ height H' and a foot portion of $\frac{3}{4}''$ height H", both the head and foot portions including no nylon fabric lays. The central or axial bore 31 in the isolator 12 is of a $1\frac{1}{2}''$ diameter, and the diameter D' of the upper face 28*a* of the frusto-conical head portion is 4". Within the main body portion of the isolator 12, the nylon fabric lays 26 are spaced $\frac{1}{4}''$ one from another, and are randomly oriented relative one to the other and relative to the center line 27 of the block 25. Each of the nylon fabric lays 26 is a $14\frac{1}{2}$ ounce nylon spun yarn woven fabric having a 49×28 thread count, the fabric being chemically treated with Chemlock 220, sold by Hughson Corp., 2000 W. Grandview Blvd., Erie, Pa. 16512, for enhanced bonding to the rubber during vulcanization of the isolator. The rubber is provided in sheet form which is laid up preliminarily between the nylon fabric lays prior to vulcanization, the rubber being in conformity with that rubber defined by ASTM No. D-2000 3AA630A13B13.

Having described in detail the preferred embodiment of my invention, what I desire to claim and protect by Letters Patent is:

1. A drawdown hopper isolation system comprising a drawdown hopper positioned in spaced relation from a support surface, said drawdown hopper including a vibration source adapted to induce vibration into said hopper, and an isolation system having a plurality of isolators supporting said hopper in spaced relation from said support surface, said isolators being positioned between said hopper and said support surface so as to be subjected to a compressive loading from said hopper, each of said isolators comprising a rubber block having a series of generally parallel woven fabric lays axially spaced one from another within said block, the warp and weft directions of each of said fabric lays being rotationally oriented in generally random rotational orientation relative to the axis of said block, and relative to the warp and weft directions of the other woven fabric lays, so as to insure relatively even lateral deflection of said isolator in response to vibration of said hopper.

2. A drawdown hopper isolation system as set forth in claim 1, said system further including structure defining an axial bore through each of said rubber blocks, a first stud fixed to said hopper and extending into one end of each of said isolator's bore, and a second stud fixed to said support surface and extending into the other end of each of said isolator's bore, said studs and said isolators cooperating to maintain said hopper in a desired horizontal position relative to said support surface.

3. A drawdown hopper isolation system as set forth in claim 1, each of said isolators comprising a generally frusto-conical head section having no fabric lays therein, said head section providing a constant minimum deflection of said isolator at a no-load condition on said hopper.

4. A drawdown hopper isolation system as set forth in claim 3, said fabric being a nylon fabric, and all of said nylon fabric lays having generally the same fabric characteristics.

5. A drawdown hopper isolation system as set forth in claim 3, each of said isolators providing an axial deflection of about 0.4 inches at a 2000 pound compression load, an axial deflection of about 1.2 inches at a 10,000 pound compression load, an axial deflection of about 2.0 inches at a 20,000 pound compression load, and an axial deflection of about 2.5 inches at a 30,000 pound compression load.

6. An isolator as set forth in claim 1, said fabric being a nylon fabric, and all of said nylon fabric lays having generally the same fabric characteristics.

7. An isolator adapted to be positioned between a device adapted to vibrate, and a support surface for said device, said isolator being positioned between said device and said support surface so as to be subjected to a compressive loading from said device during use, said isolator comprising a rubber block, and a series of generally parallel woven fabric lays axially spaced one from another within said block, the warp and weft directions of each of said fabric lays being rotationally oriented in generally random rotational orientation relative to the axis of said block, and relative to the warp and weft directions of the other woven fabric lays, so as to insure relatively even lateral deflection of said isolator in response to vibration of said hopper.

8. An isolator as set forth in claim 7, said isolator further including structure defining an axial bore through said rubber block and said fabric lays, said bore being adapted to cooperate with a first stud fixed to said device and extending into one end of said isolator's bore, and a second stud fixed to said support surface and extending into the other end of said isolator's bore, said studs and said isolator cooperating to maintain said device in a desired horizontal position relative to said support surface during use of said isolator.

9. An isolator as set forth in claim 7, said isolator further comprising a generally frusto-conical head section having no fabric lays therein, said head section providing a constant minimum deflection of said isolator at a no-load condition on said device when supported by said isolator.

10. An isolator as set forth in claim 9, said isolator providing an axial deflection of about 0.4 inches at a 2000 pound compression load, an axial deflection of about 1.2 inches at a 10,000 pound compression load, an axial deflection of about 2.0 inches at a 20,000 pound compression load, and an axial deflection of about 2.5 inches at a 30,000 pound compression load.

* * * * *